US006821586B2

(12) United States Patent
Teegarden et al.

(10) Patent No.: US 6,821,586 B2
(45) Date of Patent: Nov. 23, 2004

(54) INK JET RECORDING ELEMENT

(75) Inventors: David M. Teegarden, Pittsford, NY (US); Sridhar Sadasivan, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 169 days.

(21) Appl. No.: 10/021,227

(22) Filed: Dec. 12, 2001

(65) Prior Publication Data

US 2003/0107637 A1 Jun. 12, 2003

(51) Int. Cl.[7] ..... B41M 5/00
(52) U.S. Cl. ..... 428/32.36
(58) Field of Search ..... 428/32.36, 32.38

(56) References Cited

U.S. PATENT DOCUMENTS 5,965,252 A 10/1999 Santo et al.
5,989,687 A 11/1999 Li
6,492,005 B1 * 12/2002 Ohbayashi et al. ..... 428/195

* cited by examiner

*Primary Examiner*—Bruce H. Hess
(74) *Attorney, Agent, or Firm*—Harold E. Cole; Chris P. Konkol

(57) ABSTRACT

An inkjet recording element comprising a support having thereon an image-receiving layer comprising non-silicon-containing inorganic oxide particles, the particles having their surfaces treated with a silane coupling agent having a hydrophilic, organic moiety.

9 Claims, No Drawings

INK JET RECORDING ELEMENT

CROSS REFERENCE TO RELATED APPLICATION

Reference is made to commonly assigned, co-pending U.S. patent application Ser. No. 10/020,762 by Teegarden et al., filed of even date herewith entitled "Ink Jet Printing Method".

FIELD OF THE INVENTION

This invention relates to an ink jet recording element. More particularly, this invention relates to an ink jet recording element containing treated inorganic particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof an ink-receiving or image-forming layer, and includes those intended for reflection viewing, which have an opaque support, and those intended for viewing by transmitted light, which have a transparent support.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of inkjet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically contain colloidal particulates and have poorer image quality but exhibit superior dry times.

While a wide variety of different types of porous image-recording elements for use with ink jet printing are known, there are many unsolved problems in the art and many deficiencies in the known products which have severely limited their commercial usefulness. A major challenge in the design of a porous image-recording layer is to be able to obtain good quality, crack-free coatings with as little non-particulate matter as possible. If too much non-particulate matter is present, the image-recording layer will not be porous and will exhibit poor ink dry times.

U.S. Pat. No. 5,989,687 discloses a printing medium having at least one surface and a coating comprising the polymerization reaction product of the hydrolyzate of an aluminum alkoxide and an organoalkoxysilane. However, there is a problem with this element is that one must first perform an additional step of hydrolyzing an aluminum alkoxide to form an alumina sol before reacting with the organoalkoxysilane.

U.S. Pat. No. 5,965,252 discloses a printing medium with an ink-receiving layer comprising an alumina hydrate surface treated with a coupling agent. However, there is a problem with this element is that the coupling agents are used to render the surface of the alumina hydrate hydrophobic. Such an element would exhibit poor image quality, as inkjet inks will not wet the surface of the element uniformly.

It is an object of this invention to provide a porous ink jet recording element that has instant dry time when used in inkjet printing. It is another object of this invention to provide a porous recording element that has good coating quality, especially reduced cracking. It is another object of this invention to provide an ink jet recording element that exhibits good image quality after printing.

SUMMARY OF THE INVENTION

These and other objects are provided by the present invention comprising an ink jet recording element comprising a support having thereon an image-receiving layer comprising non-silicon-containing inorganic oxide particles, the particles having their surfaces treated with a silane coupling agent having a hydrophilic, organic moiety.

By use of the invention, an ink jet recording element is obtained that has good coating quality, and good image quality after printing.

DETAILED DESCRIPTION OF THE INVENTION

Any non-silicon containing inorganic oxide particles may be treated and used in the image-receiving layer employed in the invention. In a preferred embodiment, the inorganic oxide particles are metal oxides such as pseudo-boehmite, available commercially as 14N4-80® (SASOL Corp.), alumina, available commercially as Cabosperse PG-003® (Cabot Co.), zirconia, available commercially as Zr 50/20® (NYACOL Nano Technologies Inc.), titania, yttria, ceria, etc. In another preferred embodiment of the invention, the particle size of the inorganic oxide particles is from about 5 nm to about 1000 nm.

The treated particles used in the invention may be prepared by reacting a suitable organo-functionalized alkoxy- or chlorosilane with an inorganic oxide particle, thus altering the nature of the surface of the particle. In a preferred embodiment, such surface treatment is carried out by mixing an alkoxyorganosilane with an aqueous dispersion of the inorganic oxide particle at a pH that facilitates hydrolysis of the silane and subsequent reaction with the particle.

Silane coupling agents useful for the treatment of inorganic oxide particles as described above include 3-aminopropyltriethoxysilane, 3-aminopropyltrimethoxysilane, 3-aminopropyldiethoxymethylsilane, 3-aminopropyldimethoxymethylsilane, 3-aminopropylethoxydimethylsilane, 3-aminopropylmethoxydimethylsilane, N-(2-aminoethyl)-3-aminopropyl-trimethoxysilane, N-(2-aminoethyl)-3-aminopropyltriethoxysilane, N-(2-aminoethyl)-3-aminopropylmethyldimethoxysilane, N-(2-aminoethyl)-3-aminopropylmethyldiethoxysilane, 4-aminobutyltriethoxysilane, 4-aminobutyltrimethoxysilane, N-(2-aminoethyl)-3-aminoisobutylmethyldimethoxysilane, N-(trimethoxysilylethyl)benzyl-N,N,N-trimethylammonium chloride, N-trimethoxysilylpropyl-N,N,N-tributylammonium chloride, octadecyldimethyl(3-trimethoxysilylpropyl)ammonium chloride, N-(3-triethoxysilylpropyl)-4,5-dihydroimidazole, and other silane coupling agents listed in Gelest, Inc. catalogue, pp. 105–259 (1998). Most preferred silane coupling agents for the treatment of inorganic oxide particles used in the invention include N-(trimethoxysilylethyl)benzyl-N,N,N-trimethylammonium chloride, N-trimethoxysilylpropyl-N,N,N-tributylammonium chloride, octadecyldimethyl(3-trimethoxysilylpropyl)ammonium chloride, or N-(3triethoxysilylpropyl)-4,5-dihydroimidazole.

A wide range of ratio of coupling reagent to inorganic oxide particle may be used. In a preferred embodiment, the amount is 0.01 to 0.5 mmol of silane coupling agent per gram of particle, preferably, 0.05 to 0.15 mmol/g.

Following are examples of inorganic oxide particles treated with organofunctional silane coupling reagents useful in the invention:

TABLE 1

| Treated Particles | Inorganic oxide Particles | Silane Coupling Agent | Mmol/g |
|---|---|---|---|
| 1 | 14N4-80 ® | N-Trimethoxysilylpropyl-N,N,N-tributylammonium chloride | 0.05 |
| 2 | 14N4-80 ® | Octadecyldimethyl(3-trimethoxysilylpropyl)-ammonium chloride | 0.05 |
| 3 | 14N4-80 ® | N-(Trimethoxysilylethyl)-benzyl-N,N,N trimethyl-ammonium chloride | 0.15 |
| 4 | 14N4-80 ® | N-(3-Triethoxysilylpropyl)-4,5-dihydroimidazole | 0.15 |
| 5 | Cabosperse ®P G-003 | N-Trimethoxysilylpropyl-N,N,N-tributylammonium chloride | 0.05 |
| 6 | Cabosperse ®P G-003 | Octadecyldimethyl(3-trimethoxysilylpropyl)-ammonium chloride | 0.05 |
| 7 | Cabosperse ®P G-003 | N-(Trimethoxysilylethyl)-benzyl-N,N,N trimethyl-ammonium chloride | 0.15 |
| 8 | Cabosperse ®P G-003 | N-(3-Triethoxysilylpropyl)-4,5-dihydroimidazole | 0.15 |

In a preferred embodiment of the invention, the amount of treated inorganic oxide particles in the image-receiving layer may vary from about 40 to about 95% by weight, preferably from about 70 to about 90% by weight.

The image-receiving layer used in the invention may also contain a polymeric binder in an amount insufficient to alter its porosity. In a preferred embodiment, the polymeric binder is a hydrophilic polymer, such as poly(vinyl alcohol), polyvinylpyrrolidone, gelatin, cellulose ethers, polyoxazolines, polyvinylacetamides, partially hydrolyzed poly(vinyl acetate-co-vinyl alcohol), poly(acrylic acid), polyacrylamide, poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like; or a low Tg latex such as poly(styrene-co-butadiene), a polyurethane latex, a polyester latex, poly(n-butyl acrylate), poly(n-butyl methacrylate), poly(2-ethylhexyl acrylate), a copolymer of n-butyl acrylate and ethyl acrylate, a copolymer of vinyl acetate and n-butyl acrylate, etc. The polymeric binder should be chosen so that it is compatible with the aforementioned particles. In a preferred embodiment of the invention, the image-receiving layer thickness may range from about 1 to about 60 $\mu$m, preferably from about 5 to about 40 $\mu$m.

The amount of binder used should be sufficient to impart cohesive strength to the ink jet recording element, but should also be minimized so that the interconnected pore structure formed by the aggregates is not filled in by the binder. In a preferred embodiment of the invention, the polymeric binder is present in an amount of from about 5 to about 30% by weight.

In addition to the image-receiving layer, the recording element may also contain a base layer, next to the support, in order to absorb the solvent from the ink. Materials useful for this layer include inorganic particles and polymeric binder. In a preferred embodiment, the inorganic particles in the base layer are calcium carbonate, calcined clay, aluminosilicates, zeolites or barium sulfate. In yet another preferred embodiment, the polymeric binder in the base layer is a styrene-acrylic latex, styrene-butadiene latex or poly(vinyl alcohol).

In addition to the image-receiving layer, the recording element may also contain a layer on top of the image-receiving layer, the function of which is to provide gloss. Materials useful for this layer include sub-micron inorganic particles and/or polymeric binder.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates;

polyetherimides; and mixtures thereof. The papers listed above include a broad range of papers, from high end papers, such as photographic paper to low end papers, such as newsprint. In a preferred embodiment, Ektacolor paper made by Eastman Kodak Co. is employed.

The support used in the invention may have a thickness of from about 50 to about 500 μm, preferably from about 75 to 300 μm. Antioxidants, antistatic agents, plasticizers and other known additives may be incorporated into the support, if desired.

In order to improve the adhesion of the image-receiving layer to the support, the surface of the support may be subjected to a corona-discharge treatment prior to applying the image-receiving layer. The adhesion of the image-receiving layer to the support may also be improved by coating a subbing layer on the support. Examples of materials useful in a subbing layer include halogenated phenols and partially hydrolyzed vinyl chloride-co-vinyl acetate polymer.

The coating composition can be coated either from water or organic solvents; however, water is preferred. The total solids content should be selected to yield a useful coating thickness in the most economical way, and for particulate coating formulations, solids contents from 10–40 wt. % are typical.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

The coating composition may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 μm, preferably from about 5 to about 40 μm.

After coating, the ink jet recording element may be subject to calendering or supercalendering to enhance surface smoothness. In a preferred embodiment of the invention, the ink jet recording element is subject to hot soft-nip calendering at a temperature of about 65° C. and a pressure of 14000 kg/m at a speed of from about 0.15 m/s to about 0.3 m/s.

In order to impart mechanical durability to an ink jet recording element, crosslinkers that act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

Ink jet inks used to image the recording elements of the present invention are well known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946, 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Example 1

Synthesis of Treated Particles 1 (Invention).

A silane coupling solution was prepared by diluting 3.84 g of a 50% solution of N-(trimethoxysilyl)propyl-N,N,N-tri-n-butylammonium chloride (0.0050 mol) in 162.8 g of deionized water. This solution was added dropwise to 333.3 g of a rapidly stirring 30% dispersion of Sasol 14N4-80® pseudo-boehmite alumina. Sufficient 1 M HCl was then added to adjust the pH to 3.0. The dispersion was stirred at room temperature for 24 hours.

Synthesis of Treated Particles 2 (Invention).

These particles were prepared the same as Treated Particles 1, except that 4.14 g of a 60% solution of octadecyldimethyl(3-trimethoxysilylpropyl)ammonium chloride (0.0050 mol) was used instead of N-(trimethoxysilyl)propyl-N,N,N-tri-n-butylammonium chloride.

Synthesis of Treated Particles 3 (Invention).

These particles were prepared the same as Treated Particles 1, except that 8.35 g of a 60% solution of N-(trimethoxysilylethyl)benzyl-N,N,N-trimethylammonium chloride (0.0050 mol) was used instead of N-(trimethoxysilyl)propyl-N,N,N-tri-n-butylammonium chloride, and the amount of water used was 158.3 g.

Synthesis of Treated Particles 4 (Invention).

These particles were prepared the same as Treated Particles 1, except that 4.12 g of N-(3-triethoxysilylpropyl)-4,5-dihydroimidazole (0.015 mol) was used instead of N-(trimethoxysilyl)propyl-N,N,N-tri-n-butylammonium chloride.

Synthesis of Treated Particles 5 (Invention).

These particles were prepared the same as Treated Particles 1, except that 250.0 g of a 40% dispersion of Cabosperse PG-003 alumina was used instead of pseudo-boehmite alumina, and the amount of water used was 246.2 g.

Synthesis of Treated Particles 6 (Invention).

These particles were prepared the same as Treated Particles 5, except that 4.14 g of a 60% solution of octadecyldimethyl(3-trimethoxysilylpropyl)ammonium chloride (0.0050 mol) was used instead of N-(trimethoxysilyl)propyl-N,N,N-tri-n-butylammonium chloride, and the amount of water used was 245.8 g.

Synthesis of Treated Particles 7 (Invention).

These particles were prepared the same as Treated Particles 5, except that 8.35 g of a 60% solution of N-(trimethoxysilylethyl)benzyl-N,N,N-trimethylammonium chloride (0.0050 mol) was used instead of N-(trimethoxysilyl)propyl-N,N,N-tri-n-butylammonium chloride, and the amount of water used was 241.7 g.

Synthesis of Treated Particles 8 (Invention).

These particles were prepared the same as Treated Particles 5, except that 4.12 g of N-(3-triethoxysilylpropyl)-4,5-dihydroimidazole (0.015 mol) was used instead of N-(trimethoxysilyl)propyl-N,N,N-tri-n-butylammonium chloride, and the amount of water used was 245.9 g.

Element 1 of the Invention

A coating solution for a base layer was prepared by mixing 254 dry g of precipitated calcium carbonate Albagloss-s® (Specialty Minerals Inc.) as a 70 wt. % solution, 22 dry g of silica gel Gasil® 23F (Crosfield Ltd.), 2.6 dry g of poly(vinyl alcohol) Airvol® 125 (Air Products) as a 10 wt. % solution, 21 dry g of styrene-butadiene latex CP692NA® (Dow Chemical Co.) as a 50 wt. % solution and 0.8 g of Alcogum® L-229 (Alco Chemical Co.). The solids of the coating solution was adjusted to 35 wt. % by adding water. The base layer coating solution was bead-coated at 25° C. on Ektacolor Edge Paper (Eastman Kodak Co.) and dried by forced air at 60° C. The thickness of the base layer was 25 $\mu$m or 27 g/m$^2$.

A coating solution for the image receiving layer was prepared by mixing 148 dry g of Treated Particles 1 (19.7 wt. % solids) with 44 dry g of Treated Particles 5 (19.2 wt. % solids), 6 dry g of poly(vinyl alcohol) Gohsenol® GH-17 (Nippon Gohsei Co. Ltd.) (10 wt. % solution), 1.5 dry g of Silwet L-7602® (Witco Co.), 1.5 dry g of Zonyl FS-30® (DuPont Co.) and 0.2 dry g of 1,4-dioxane-2,3-diol (Aldrich Chemical Co.). The coating solution was then diluted to 15 wt. % solids.

The image-receiving layer coating solution was bead-coated at 25° C. on top of the base layer described above. The recording element was then dried by forced air at 104° C. for 5 minutes. The thickness of the image-receiving layer was 8 $\mu$m or 8.6 g/m$^2$.

Element 2 of the Invention

This element was prepared the same as Element 1 except that 148 dry g of Treated Particles 2 (20.0 wt. % solids) was used instead of Treated Particles 1 and 44 dry g of Treated Particles 6 (20.2 wt. % solids) was used instead of Treated Particles 5 in the image-receiving layer.

Element 3 of the Invention

This element was prepared the same as Element 1 except that 148 dry g of Treated Particles 3 (20.0 wt. % solids) was used instead of Treated Particles 1 and 44 dry g of Treated Particles 7 (20.2 wt. % solids) was used instead of Treated Particles 5 in the image-receiving layer.

Element 4 of the Invention

This element was prepared the same as Element 1 except that 148 dry g of Treated Particles 4 (18.7 wt. % solids) was used instead of Treated Particles 1 and 44 dry g of Treated Particles 8 (20.8 wt. % solids) was used instead of Treated Particles 5 in the image-receiving layer.

Comparative Element C-1 (contains no treated particles)

A coating solution for the image-receiving layer of this element was prepared by mixing 148 dry g of alumina Dispal® 14N4-80 (Condea Vista) as 20 wt. % solution, 44 dry g of fumed alumina Cab-O-Sperse® PG003 (Cabot Corp.) as a 40 wt. % solution, 6 dry g of poly(vinyl alcohol) Gohsenol® GH-17 (Nippon Gohsei Co. Ltd.) as a 10 wt. % solution, 1.5 g of Silwet® L-7602 (Witco. Corp.), 1.5 g of Zonyl®FS-30 (Dupont Co.) and 0.2 g of di-hydroxy dioxane (Aldrich Co.). The coating solution was then diluted to 15% solids.

The image-receiving layer coating solution was bead-coated at 25° C. on top of the base layer described above. The recording element was then dried by forced air at 60° C. for 80 seconds followed by 38° C. for 8 minutes. The thickness of the image-receiving layer was 8 $\mu$m or 8.6 g/m$^2$ Coating Quality The above dried coatings for visually evaluated for cracking defects. The results are tabulated in Table 2 below.

Image Quality & Dry Time

An Epson Stylus Color 740 printer for dye-based inks using Color Ink Cartridge S020191/IC3CL01 was used to print on the above recording elements. The image consisted of adjacent patches of cyan, magenta, yellow, black, green, red and blue patches, each patch being in the form of a rectangle 0.4 cm in width and 1.0 cm in length. Bleed between adjacent color patches was qualitatively assessed. A second image was printed, and immediately after ejection from the printer, the image was wiped with a soft cloth. The dry time was rated as 1 if no ink smudged on the image. The dry time was rated as 2 if some ink smudged, and 3 if a relatively large amount of ink smudged. The results are tabulated in Table 2 below.

TABLE 2

| Element | Coating Quality | Image Quality | Dry Time |
|---|---|---|---|
| 1 | No cracking | Little or no bleeding | 1 |
| 2 | No cracking | Little or no bleeding | 1 |
| 3 | No cracking | Little or no bleeding | 1 |
| 4 | No cracking | Little or no bleeding | 1 |
| C-1 | Cracking | Bleeding | 1 |

The above table shows that the recording elements of the invention have good coating quality and image quality as compared to the comparative recording element along with a good dry time.

This invention has been described with particular reference to preferred embodiments thereof but it will be understood that modifications can be made within the spirit and scope of the invention.

What is claimed is:

1. An ink jet recording element comprising a support having thereon an image-receiving layer comprising a polymeric binder in an amount of from about 5 to about 30% by weight and alumina particles, in an amount of from about 40 to about 95% by weight and having their surfaces treated with a silane coupling agent, having a hydrophilic, organic moiety, in an amount of from about 0.01 to about 0.5 mmol/gram.

2. The recording element of claim 1 wherein said silane coupling agent is N-(trimethoxysilylethyl)benzyl-N,N,N-trimethylammonium chloride; N-trimethoxysilylpropyl-N,N,N-tributylammonium chloride; octadecyldimethyl(3-trimethoxysilylpropyl)ammonium chloride; or N-(3-triethoxysilylpropyl)-4,5-dihydroimidazole.

3. The recording element of claim 1 wherein said polymeric binder is poly(vinyl alcohol).

4. The recording element of claim 1 wherein said image-receiving layer is present at a thickness of from about 1 $\mu$m to about 60 $\mu$m.

5. The recording element of claim 1 wherein said alumina particles have a particle size of from about 5 nm to about 1,000 nm.

6. The recording element of claim 1 wherein a base layer is present in between said support and said image-receiving layer.

7. The recording element of claim 6 wherein said base layer comprises inorganic particles and a polymeric binder.

8. The recording element of claim 7 wherein said inorganic particles are calcium carbonate, calcined clay, aluminosilicates, zeolites or barium sulfate.

9. The recording element of claim 7 wherein said polymeric binder is a styrene/acrylic latex, styrene/butadiene latex or poly(vinyl alcohol).

* * * * *